United States Patent [19]

Hackmann et al.

[11] Patent Number: 4,832,229

[45] Date of Patent: May 23, 1989

[54] DISPENSER

[75] Inventors: Ludger Hackmann; Guenther Pohlmann, both of Lohne/Oldenburg; Viktor Seifert; Johannes Weid, both of Berlin, all of Fed. Rep. of Germany

[73] Assignee: Bramlage Gesellschaft mit beschraenkter Haftung, Fed. Rep. of Germany

[21] Appl. No.: 878,997

[22] Filed: Jun. 26, 1986

[30] Foreign Application Priority Data

Jun. 28, 1985 [DE] Fed. Rep. of Germany ..... 3523173

[51] Int. Cl.[4] ..... G07F 11/66

[52] U.S. Cl. ..... 221/25; 221/71; 221/185; 221/213; 221/259; 221/277; 221/312 C; 225/16; 225/23; 225/44; 225/45; 225/39

[58] Field of Search ..... 206/403, 404, 408, 413, 206/438, 37, 39, 39.3, 39.4, 39.8; 242/55.2

[56] References Cited

U.S. PATENT DOCUMENTS

| | | | |
|---|---|---|---|
| 1,754,957 | 4/1930 | Lorentzen | 221/42 |
| 3,051,352 | 8/1962 | Greene | 221/26 |
| 3,367,535 | 2/1966 | Tanguay | 221/71 |
| 3,466,963 | 9/1969 | Palson | 156/530 |
| 3,861,985 | 1/1975 | Parlagreco | 221/213 X |
| 3,930,927 | 1/1976 | Thompson | 83/226 |
| 3,964,638 | 6/1976 | Dimauro | 221/25 X |
| 4,030,602 | 6/1977 | Müller et al. | 206/404 |
| 4,073,422 | 2/1978 | Palter | 226/129 |
| 4,561,544 | 12/1985 | Reeve | 206/807 X |
| 4,566,606 | 1/1986 | Kling | 221/25 |

FOREIGN PATENT DOCUMENTS

| | | | |
|---|---|---|---|
| 13723 | 6/1956 | Fed. Rep. of Germany | 206/389 |
| 2336315 | 12/1975 | France . | |
| 261101 | 8/1949 | Switzerland . | |
| 2084119 | 4/1982 | United Kingdom | 215/201 |

*Primary Examiner*—Michael S. Huppert
*Assistant Examiner*—David H. Bollinger
*Attorney, Agent, or Firm*—Wood, Herron & Evans

[57] ABSTRACT

A dispenser is disclosed for dispensing strips which contain medicine and can be divided into individual sections as they are dispensed. The dispenser includes a housing having a storage space for strips and a discharge passageway through which strips are dispensed. A ramp interconnects the storage space and passageway. A feed wheel having a peripheral gear feeds strips along the ramp. The feed wheel is actuated by a member operable from outside the housing. The actuating member shifts a drive pawl which engages the peripheral gear on the feed wheel. A cap is secured over the dispensing end of the housing and is held in place by a snap connection.

9 Claims, 4 Drawing Sheets

DISPENSER

BACKGROUND OF THE INVENTION

The present invention relates to dispensers of the type having a dispensing transport device, for dispensing strips which contain medicine. These strips are transported from a storage space within the dispenser to a discharge passageway and are divided in individual sections as they are dispensed.

The problem underlying the invention is to so design a dispenser of this type which is simple-to-manufacture, easy to use and which is effective to dispense medicinal strips in a hygenic condition.

SUMMARY OF THE PRESENT INVENTION

The present invention contemplates a dispenser including a housing having a storage compartment for holding a medicinal strip which can be divided along a series of transverse perforations, a discharge passageway through which the strip exits the housing and a transport device for advancing the strip incrementally from the storage compartment through the discharge passageway.

In accordance with the present invention the strip is not touched during dispensing. The dispenser is activated by means of an actuator member; e.g., a button on the housing. The cross sectional area of the discharge slot substantially matches the cross section of the strip so that the strip within the housing is maintained in a hygenic condition. The transport mechanism includes a wheel having peripheral teeth which engage the strip and when rotated advance the strip through the discharge passageway. The wheel is advanced by means of a drive pawl carried by the actuating member which acts on the peripheral teeth on the wheel.

One advantage of the present dispenser is that it is simple to use. Furthermore, the product stored; e.g., a detachable "tablet" strip coated with a reactive agent is optimally protected. Finger contact with the contents is prevented. Thus, the dispenser serves as an effective protective package, which can be readily carried by the user, for instance, in a coat pocket. The present container can function as a small package by filling it with an elongated strip in loop form. Alternatively, the package can serve as a large size container by eventually filling it with a rolled strip. Moreover, the present container which dispenses a "tablet" strip has not only the advantage of saving space but also is quieter in comparison with a container filled with loose tablets. Moreover, the immobility of the tablets combined in a strip reduces the degree of abrasion. This eliminates the unfavorable disintegration of tablets or the necessity of providing a stronger bond of the tablet substance. A strip appropriately coated or saturated with reactive agent may consist of so-called edible paper as the substrate. Gelatin type strips can be utilized as well. In order to optimize the hygenic conditions, the feed wheel of the dispensing transport mechanism is sealed and is located adjacent to the discharge passageway. Due to cross sectional similarity of the discharge passageway and strip, the stored strip and wheel are substantially sealed by the strip itself. The transport feed wheel itself covers the strip in noncontact fashion. The wheel is activated by a push button which is preferably incorporated in a protective cover in that it forms part of the dispenser housing. Consequently, the only opening in the housing is sealed by the strip which acts the same as a plug. The dispensing transport device engaging the strip is so constructed that the tear-off line of a strip section which is positioned for dispensing lies within the discharge passageway. Consequently, the following strip section is not touched by the finger of the user as the strip section ready for dispensation is detached. The dispensing end of the dispenser housing is covered by a cap which is lock onto the dispenser housing so as to form a safety catch to protect against dispensing by a child. In one embodiment the child safety catch and a pawl interacting with the transport feed wheel are joined on opposite sides of the same wall section of the dispenser housing. Both functional components are thus joined in a single zone of the housing and mutually stiffen one another. One advantageous actuator for the transport wheel includes a drive pawl formed on the inside wall of the cap. In this embodiment the front wall of the cap is spaced from the mouth end of the discharge passageway. As the cap is put in place, the next strip section moves into the advanced position ready for tearing off. The spacing between the cap and discharge passageway avoids buckling of this section of the strip. It has further been found advantageous to provide a ramp between the storage space and discharge passageway. The strip extends into the discharge passageway which is disposed parallel to the housing support bottom for the strip.

These and other objects and advantages of the present invention will be more fully explained hereafter in relation to the drawings illustrating three embodiments of the invention.

DETAILED DESCRIPTION OF THE DRAWINGS

FIG. 1 is a side elevational view of the first embodiment of the present dispenser;

FIG. 2 a plan view of the dispenser of FIG. 1;

DESCRIPTION OF PREFERRED EMBODIMENTS

Figure 4:
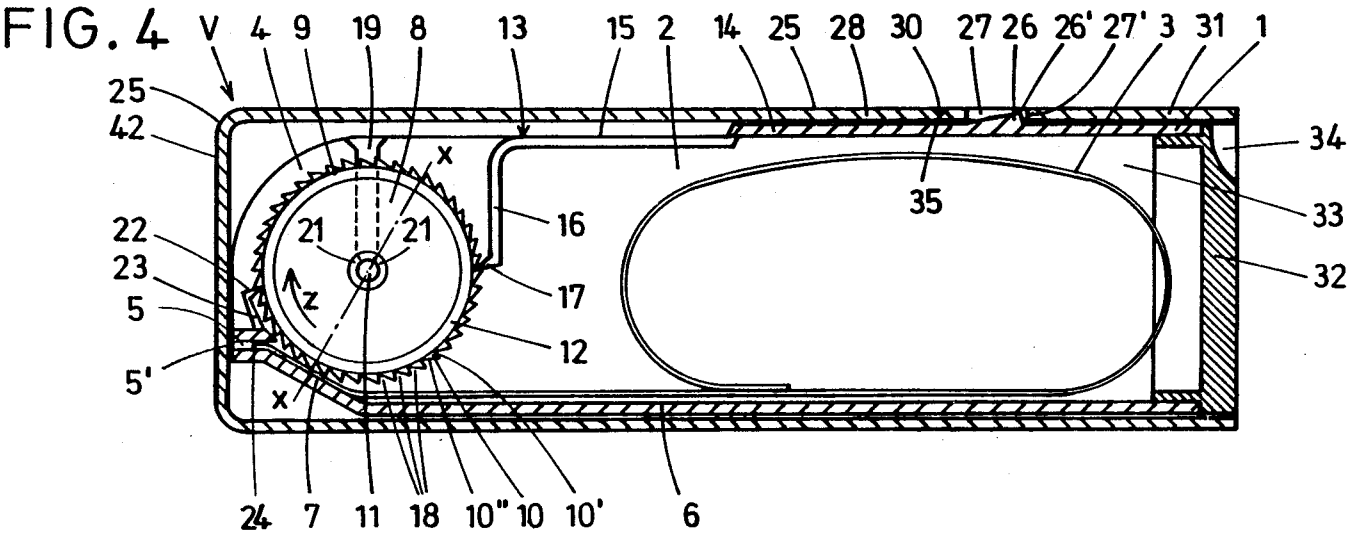
FIG. 4 is a cross sectional view taken along line IV—IV of FIG. 5.
Figure 5:
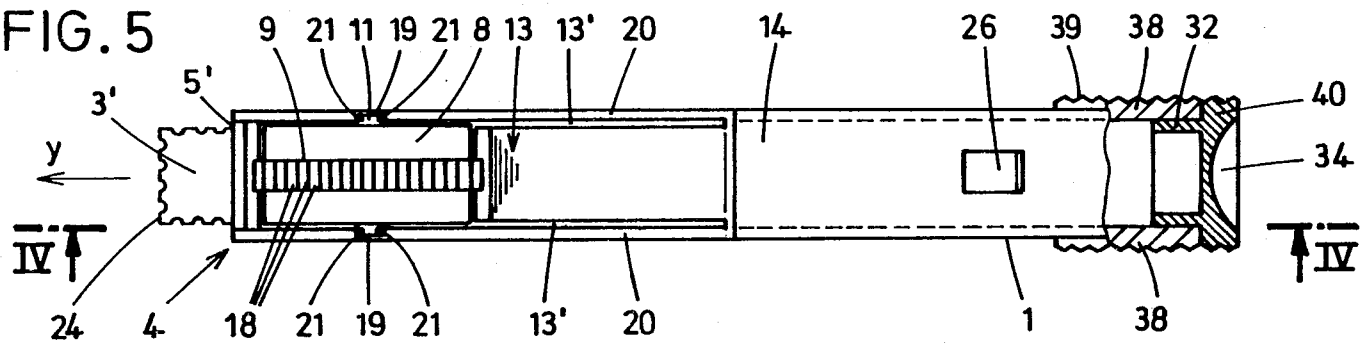
FIG. 5 is a plan view of the dispenser with the cap.

As shown in FIG. 4, a preferred form of dispenser includes an oblong housing 1. Most of its longitudinal section of the housing forms a storage space 2 for medicine having the form of a strip 3.

In the area of the dispenser head 4 illustrated at the left of the drawing, the housing forms at bottom left a horizontally extending, relatively short discharge passageway 5. The inner end of the passageway is adjacent to a ramp 7 having an acute-angle inclination toward horizontal support bottom 6 of housing 1. The angle of inclination is about 30°. The length of the ramp equals about twice to three times the length of discharge passageway 5.

The long rectangular cross section of the discharge passageway corresponds to that of the strip 3, so that the latter will fill the passageway cross section.

A line through the center of ramp 7 and perpendicular thereto intersects the axis of transport feed wheel 8. The latter is part of a dispensing transport device V in the area of the dispenser head 4. The transport wheel 8 extends across the entire clearance of the discharge passageway 5 and includes a sealed gear rim 9 disposed on the transverse center portion of the transport wheel. The gear rim has a saw tooth structure, that is, the one face 10′ of the teeth 10 extends radially to the horizontal transport wheel axle 11 which, in turn, extends transverse to the dispensing direction y, whereas the other face 10″ extends at a small angle from the circumference of the narrow gear rim web 12. The face 10′ is shown slightly relieved in the drawing. The tooth points engage the strip passing across the ramp 7.

Figure 6:
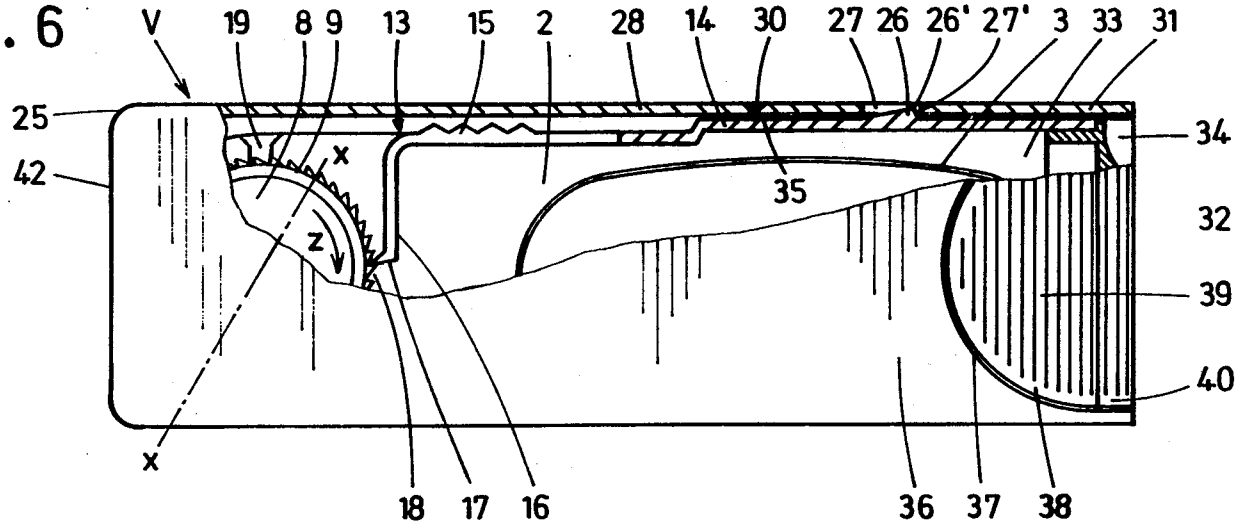
FIG. 6 is a cross sectional view taken along line VI—VI in FIG. 7, illustrating a second embodiment of the dispenser.
Figure 7:
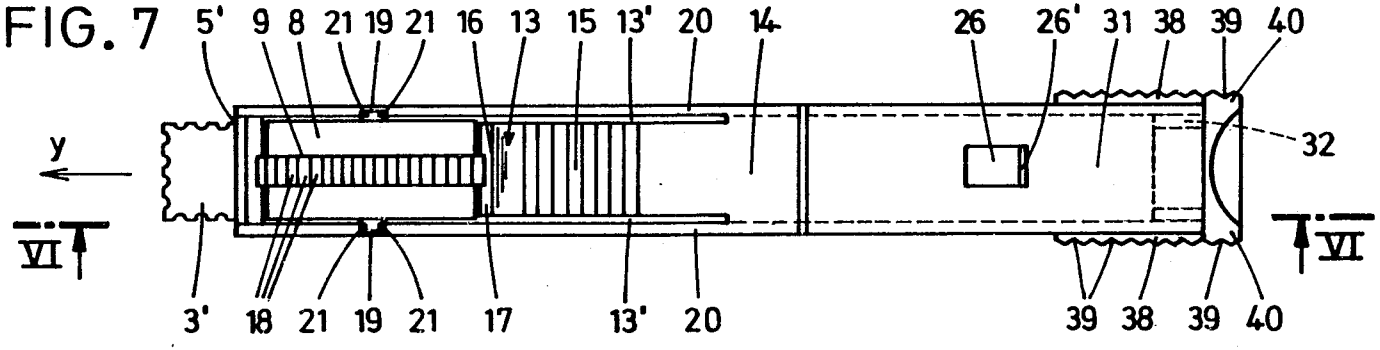
FIG. 7 is a plan of a second embodiment of the dispenser with the cap removed.

The dispensing transport device V also comprises a button 13. In the first and second embodiments, the latter is formed by a tab 15 which is slit from the top wall 14 of the housing 1. The slitting lines are marked 13′. The free end of the tab, which according to FIG. 6 is grooved crosswise, includes a tongue 16 pointing downward. A drive pawl 17, angled in the direction of the transport wheel 8, engages the tooth gaps of the gear rim 9. The tongue 16 is slightly prestressed, preferably as a result of the injection molding operation, so that it is a spring-loaded into engagement with the teeth of gear 9. In the first and second embodiments, pawl 17 engages a tooth located approximately on the level of the wheel axle 11. When it is pushed down, the pawl 17 puts a load on the steep face 10′, rotating the transport wheel in the direction of arrow z until the pawl 17 disengages the tooth gap after an angular travel of about 30°.

The slight spring loading acts transverse to two vertical upwardly open mounting slots 19 for the journals of the wheel axle 11 which protrude sideways beyond the transport wheel. These mounting slots are located in the vertical side walls 20 of the housing and extend parallel to each other. The slots 19 are open on their inner portions; i.e., they are open toward each other. Locking projections 21 extend on both side of the slots above the bottom bearing trough, portion of the slots securing the axle in position.

The outer tips of the teeth 10 sweep across the ramp 7 at a spacing such that the strip 3 will be shifted by the teeth when the button is actuated. To prevent the transport wheel 8 from being carried in the direction of arrow z as the button retracts, the transport wheel is fashioned as a pawl wheel and interacts with a pawl 22 in the fashion of a rachet lock. Pawl 22 is formed from an elastic wall section 23 of the dispenser housing 1. According to the embodiments shown in FIGS. 4 through 7, this wall section 23 extends diametrically opposite to the driver pawl 17. The pawl 22 also has a slight prestress. Its head bears on the radially aligned or slightly relieved, respectively, face 10′ of the teeth. In the embodiment shown in FIGS. 8 and 9, however, the pawl 22 originates on the inside of the top wall 14 of the housing 1. There, its head is not angled radially inward as illustrated in FIG. 4; instead, the pointed from end bears in locking fashion, in FIG. 8, on the steep or relieved face 10′.

The dispensing transport device v engaging in the strip 3 is constructed so that a tear-off line 24 of the strip 3, formed for instance by transverse perforation, will in dispensing position (FIGS. 5, 7, 9) of a strip section 3′ still be located within the discharge passageway 5. About three fourths of the length of the section ready for dispensation extends through the mouth end 5′ of the discharge passageway 5 for easy gripping. This prevents the following strip section 3′ from coming into contact with the operator's hand.

Figure 1:
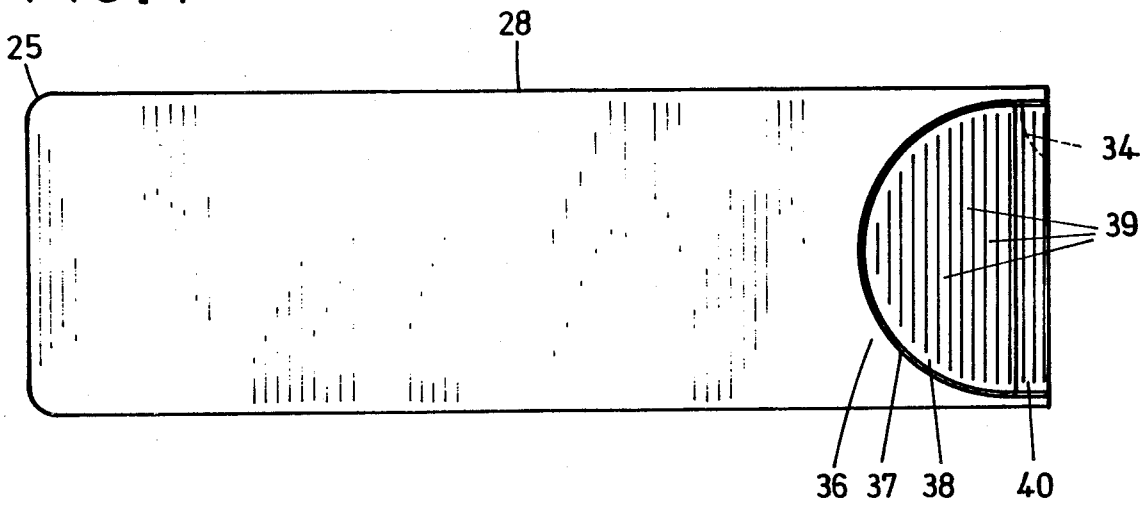
Figure 2:
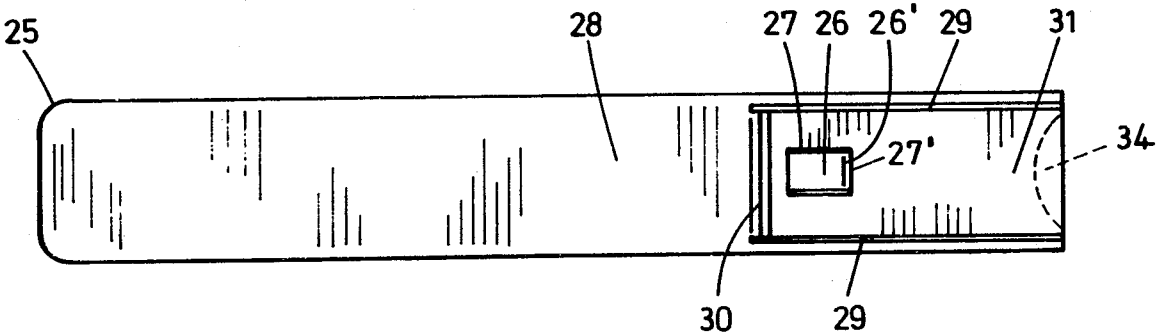
Figure 3:
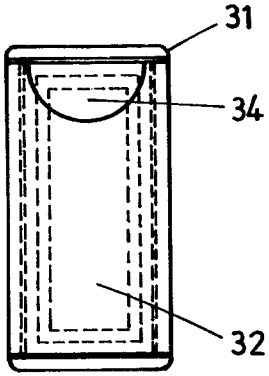
FIG. 3 is a rear view of the dispenser of FIG. 1.

To actuate the button 13, a cap 25 covering five sides of the housing 1 must be removed first. The cap serves as a child safety feature (i.e., it prevents dispensing of contents by children) and snaps over the dispenser housing 1. The housing has on the top side of its top wall 14 a locking projection 26 which interacts with a depression or cutout 27 in the cap. In the assembled position of the cap, which is limited by a stop, a steep locking face 26′ of the locking projection 26 is positioned in a blocking fashion in engagement with the corresponding cutout edge 27′. To remove the cap and thereby defeat the child safety, the locked connection must be released which is a procedure which is not readily apparent. To facilitate releasing the locked connection, the section of the cap wall 28 opposing the top well 14 in the snap connection area is separated by slits extending inwardly from the open end. Slit lines 29 can be seen clearly in FIG. 2.

A transverse bead 30 is provided just behind cut-out 27 so that the snap-in tab 31 can swing upwardly without breaking off. The rim face of the releasable cap 25 is coplanar with the back of a plug 32 which seals a filling opening 33 which is located in the housing opposite the discharge passageway 5. The plug 32 has a small depression 34 below the snap in tab 31. A user can insert his fingernail in depression 34 reaching from inside underneath the free end of the tab and pushing it upward around the hinge point 35 created by the bead 30. For convenient insertion of the fingernail or tip of the finger, respectively, depression 34 is rounded crosswise, as can be seen from FIG. 5. The plug 32 is designed as a hollow plug so that it does not reduce the storage space 2. The hollow plug can readily be inserted into the dispenser housing, after the free end of the strip 3 is introduced into the discharge passageway 5 by moving it along ramp 7 with the aid of the button 13. This feeding action is facilitated by the upper wall of the passageway which protrudes in rooflike fashion in the feeding direction of the strip.

To assist the operator in holding the housing 1 as the cap is removed, the side walls 36 of the housing have a semi-circular cut out or niche in the area of the end comprising the refill opening. The respective niches are marked 37. These latter are engaged by gripper jaws 38 of the dispenser housing 1 that are similar in contour. The jaws are molded to the housing as outward protrusions and are configurated to form grooves 39 transverse to the direction of pull-off. The grooves 39 extend without interruption into a plug head 40. The plug is held by a pinch fit so that a deliberate removal force is required. Plug 40 is not recognizable as a separate component and forms only a relatively narrow gripping area near the end of the housing and consequently a force applied to the center portion of the jaws; i.e., across the joint, will not readily result in the release of the plug. For this reason, quite effective protection is provided against accidental opening by a child.

Figure 8:
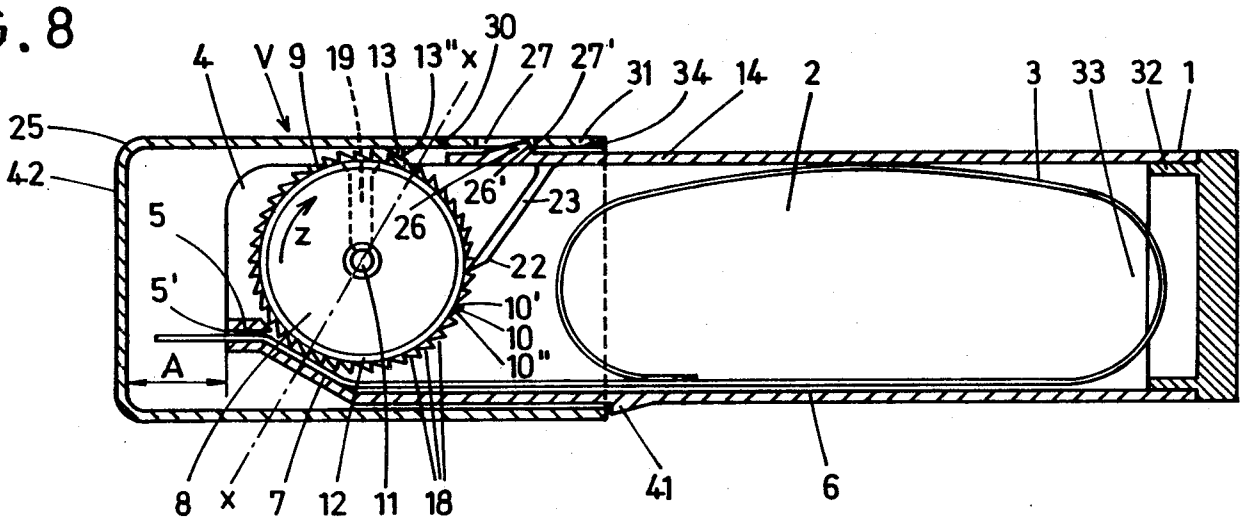
FIG. 8 is a cross sectional view taken along line VIII—VIII of FIG. 9, illustrating a third embodiment of the dispenser.
Figure 9:
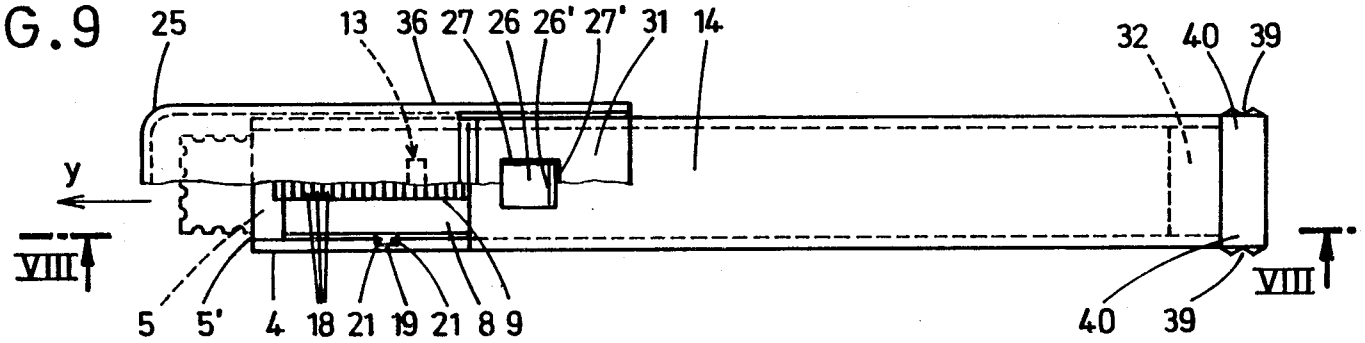
FIG. 9 is a plan view of the dispenser of FIG. 8 with the cap, which in addition to the child safety forms here the actuating button, partly cut away.

The embodiment shown in FIGS. 8 and 9 uses a cap 25 of shorter length than the cap of the previous embodiments. Components of this embodiment corresponding to those previously described are not redescribed in detail. The snap projection 26 retaining the cap 25 extends outward in the immediate vicinity of the transport wheel 10. Pawl 22 extends inwardly adjacent to projection 26 so that pawl and child safety catch (snap projection 26) extend from generally the same section of the wall 14, but in opposite directions. Thus, the root areas of both functional components are mutually stabilized. This is advantageous for removal of the part from the mold.

A further difference from the earlier embodiments relates to the activator member 13, which is fashioned here as a drive on the cap 25 which interacts directly with the gear rim 9. As the cap is slipped in place, limited by a stop, the strip section 3' is being advanced to a position ready for dispensation. This is because the steep face 13' of the activator member 13, shown vertical in FIG. 8, will seat on the steep face 10' of the respective tooth 10 in capping. In uncapping, however, the member 13 due to the small height of its back face, slips over the backs of the teeth 10 without entraining the transport wheel 8, with the pawl 22 retaining the wheel against movement.

The capping stop is formed by a projection 41 which is molded to the outside of the support bottom 6.

In the embodiment of FIGS. 8 and 9 a recess is molded in the snap tab 31. This recess facilities raising the snap tab 31 in a manner similar to recess 34.

In another variation snap tab 31 is formed as a section which is not separated by slits but is rigid, while the section facing the snap projection 26 and the pawl 22 are separated from the adjacent housing by slits in the fashion of a tongue. In this variation, pawl 22 can be pushed down as a button when slipping the cap 25 in place. The dispensation of the strip is accomplished during the retraction stroke of the cap. In this embodiment a racket type pawl would be provided by molding, as explained in conjunction with FIG. 4.

In both the embodiment shown in FIGS. 8 and 9 and the above described variation (not shown), the front wall 42 of the cap 25 extends a distance A from the mouth end 5' of the discharge passageway 5, so that the section 3' of the strip can freely be advanced from mouth 5'.

The storage space 2 contains only one strip which extends along the entire length of the housing and extends into a loop. This degree of filling equals a small pack. Similarly, a large pack could be obtained simply by utilizing all the volume of space 2 with a strip which is stored in a rolled condition. Upon inserting the plug 32, the contents are sealed at the filling end and thus are not easily accessible to touch. When placing a cap 25 over the transport wheel 8, the strip is further protected from contact.

From the above disclosure of the general principles of the present invention and the above description of three preferred embodiments, those skilled in the art will readily comprehend the various modifications to which the present invention is susceptible. Accordingly, we desire to be limited only by the scope of the following claims.

Having described our invention we claim:

1. A dispenser for dispensing strips which contain medicine, said strips having transverse lines of weakening along which said strips can be divided into individual sections as they are dispensed, said dispenser comprising:

a housing configured to form a storage space for a strip;

a discharge passageway through which said strip is dispensed;

a rotatable feed wheel mounted within said housing;

an actuating member movably mounted on said housing, said feed wheel having a peripheral gear formed thereon, said gear being disposed in engagement with said strip and being effective to advance said strip through said discharge passageway when said feed wheel is rotated;

a drive pawl interconnected to said actuating member for movement therewith, said drive pawl engaging said peripheral gear for rotating said feed wheel in response to movement of the pawl upon movement of said actuating member.

2. The dispenser of claim 1 further comprising a second pawl mounted within said housing and disposed for engagement with said peripheral gear for preventing reverse movement of said feed wheel.

3. The dispenser of claim 1 in which said actuator member, drive pawl and feed wheel are constructed and disposed in relation to said strip so that when said actuating member is fully advanced, the one of said transverse lines of weakening adjacent the portion of the strip extending outwardly beyond said discharge passageway remains disposed within said discharge passageway.

4. The dispenser of claim 1 further comprising a cap, said cap being disposed over the portion of the dispenser housing including said discharge passageway, and snap connection means releasably locking said cap in its assembled position with said housing.

5. The dispenser of claim 4 in which said snap connection means comprise a lug extending outwardly from said housing and an opening in said cap.

6. The dispenser of claim 5 in which said drive pawl is mounted upon a section of said dispenser housing adjacent to said lug.

7. The dispenser of claim 1 in which said discharge passageway includes a mouth through which said strip is dispensed, said cap comprising an end wall, and stop means carried by said housing disposed for engagement with the cap for maintaining the end wall of said cap spaced a predetermined distance from said mouth end of said discharge passageway.

8. The dispenser of claim 1 further comprising a ramp disposed intermediate said storage space and said discharge passageway, said housing including a bottom wall in engagement with said strip, and said discharge passageway extending parallel to said bottom wall, and said ramp interconnecting said bottom wall and said discharge passageway.

9. The dispenser of claim 8 in which said feed wheel presses said strip against said ramp and, upon rotation of said feed wheel, said gear in engagement with said strip urges said strip from said ramp into said discharge passageway.

* * * * *